US007232775B1

(12) United States Patent
Scaringe et al.

(10) Patent No.: US 7,232,775 B1
(45) Date of Patent: Jun. 19, 2007

(54) CONNECTOR BODY FOR A LEAD ATTACHMENT RETROFIT ARRANGEMENT

(75) Inventors: Robert P. Scaringe, Rockledge, FL (US); Gregory S. Cole, Melbourne, FL (US)

(73) Assignee: Mainstream Engineering Corp., Rockledge, FL (US)

( * ) Notice: Subject to any disclaimer, the term of this patent is extended or adjusted under 35 U.S.C. 154(b) by 0 days.

(21) Appl. No.: 11/431,670

(22) Filed: May 11, 2006

(51) Int. Cl.
*H01R 4/36* (2006.01)

(52) U.S. Cl. ..... 438/810; 439/814

(58) Field of Classification Search ..... 439/810, 439/807, 811, 812, 801
See application file for complete search history.

(56) References Cited

U.S. PATENT DOCUMENTS 2,017,493 A * 10/1935 Glowacki ..... 439/801
3,707,698 A * 12/1972 Robinson et al. ..... 439/431
3,710,307 A * 1/1973 Cooper, Jr. ..... 439/523
3,740,702 A * 6/1973 Moray ..... 439/866
3,757,282 A * 9/1973 Wildi ..... 439/491
4,619,497 A * 10/1986 Vogel et al. ..... 439/792
5,137,476 A * 8/1992 Noble ..... 439/797
5,632,633 A * 5/1997 Roosdorp et al. ..... 439/100
5,906,515 A * 5/1999 Lin ..... 439/620.3
5,957,733 A * 9/1999 Mello et al. ..... 439/814
6,048,233 A * 4/2000 Cole ..... 439/807
6,453,540 B1 * 9/2002 Blakelock et al. ..... 29/598
6,565,393 B1 * 5/2003 Cole ..... 439/807

* cited by examiner

*Primary Examiner*—Tulsidas C. Patel
*Assistant Examiner*—Vladimir Imas
(74) *Attorney, Agent, or Firm*—Crowell & Moring LLP

(57) ABSTRACT

A retrofit arrangement for attacking an electrical lead to a terminal has a body consisting of a conductive central portion and a non-conductive portion substantially surrounding the central portion.

10 Claims, 4 Drawing Sheets

CONNECTOR BODY FOR A LEAD ATTACHMENT RETROFIT ARRANGEMENT

BACKGROUND AND SUMMARY OF THE INVENTION

The present invention relates to a connector body for a retrofit arrangement to attach leads to compressor motor terminals as described in U.S. Pat. Nos. 6,048,233 and 6,565,393, the disclosures of which are incorporated by reference herein.

An object of the present invention is to provide a connector body which, overall, provides a non-conducting body while also having the advantage of a larger electrical contact area.

One advantage of the present invention is that it avoids the need for extensive cleaning up of the compressor posts that can become seriously pitted with significant carbon residue. The present invention avoids this cleaning step by providing an effectively greater conducting contact surface area by virtue of the fact that now all contacting surfaces are conducting. Thereby, the current per surface area is reduced and avoids the need for substantial amounts of contact surface cleaning.

Still another advantage of the present invention is that the conducting central section has a transient thermal capacity to minimize thermal temperature swings because there is still some electrical resistance between the compressor post and the retrofit arrangement even with an effectively doubled contact surface area which reduces resistance by about one-half.

Other objects, advantages and novel features of the present invention will become apparent from the following detailed description of the invention when considered in conjunction with the accompanying drawings.

BRIEF DESCRIPTION OF THE DRAWING FIGURES

DETAILED DESCRIPTION OF THE PREFERRED EMBODIMENTS

Figure 1:
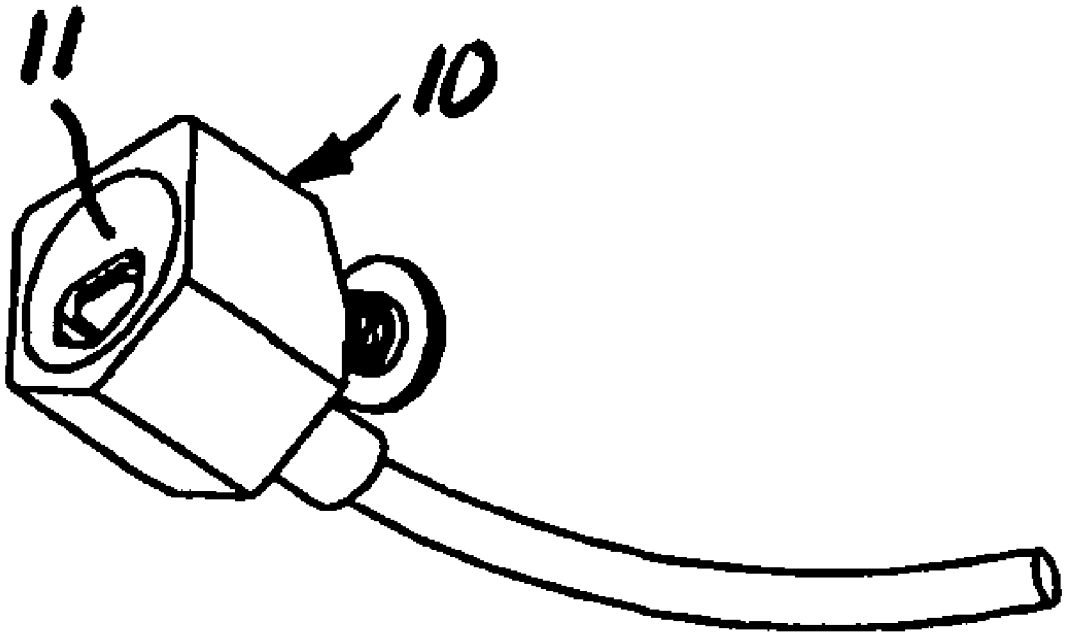
FIG. 1 is a perspective view of the overall retrofit arrangement including the connector body of the present invention.

The structure and use of the retrofit arrangement of the type involved with the present invention is fully disclosed in U.S. Pat. No. 6,565,393. Therefore, the details thereof will be dispensed with for the sake of conciseness. Specific reference is made to FIGS. 2 and 3*a* to 3*c* and the corresponding description thereof on said U.S. patent for details concerning the structure of the connector body which is designated generally by the reference numeral 10 in FIGS. 1 to 4 of the present application.

The connector body 10 of the present invention is not made up entirely of a non-conductive, non-metallic material. Instead, a central section 11 is made of an electrically conductive material and is surrounded by the non-conductive material used on the prior configuration described in said U.S. patent.

By utilizing a softer conductor material such as brass, copper, aluminum, stainless steel, or for that matter, any conducting material that is softer than the standard carbon steel posts of a compressor, electrical and thermal connectivity is greatly enhanced because the compressor steel posts are able to dig into the softer conductive material. That is, the effective contact surface area is effectively doubled with all-conductive contact surfaces that, in addition, have improved connectivity. Notwithstanding the fact that the same electrical resistance remains between the compressor steel posts and the retrofit arrangement, the conducting central section has a transient thermal capacity that minimizes thermal temperature swings associated with transient high current surges as may occur during compressor start-up. In addition, the central section used on the present invention provided additional thermal paths for conducting this generated heat.

In the earlier configurations described in said U.S. patents incorporated herein by reference the metal space at the end of the lead wire was pressed against the compressor post to make the electrical contact. We have found, however, that such a contact is primarily a line contact with the spade being tangential to the cylindrical post which is often the case when dealing with a compressor that has been operating in the field and the flat spade welded to the post when the compressor is new becomes severely pitted, leaving only the cylindrical post for making the connection. The present invention has the advantage of accommodating either a complete post (i.e., post and flat spade) or a cylindrical post which has become severely pitted with substantial amounts of carbon residue.

Figure 2:
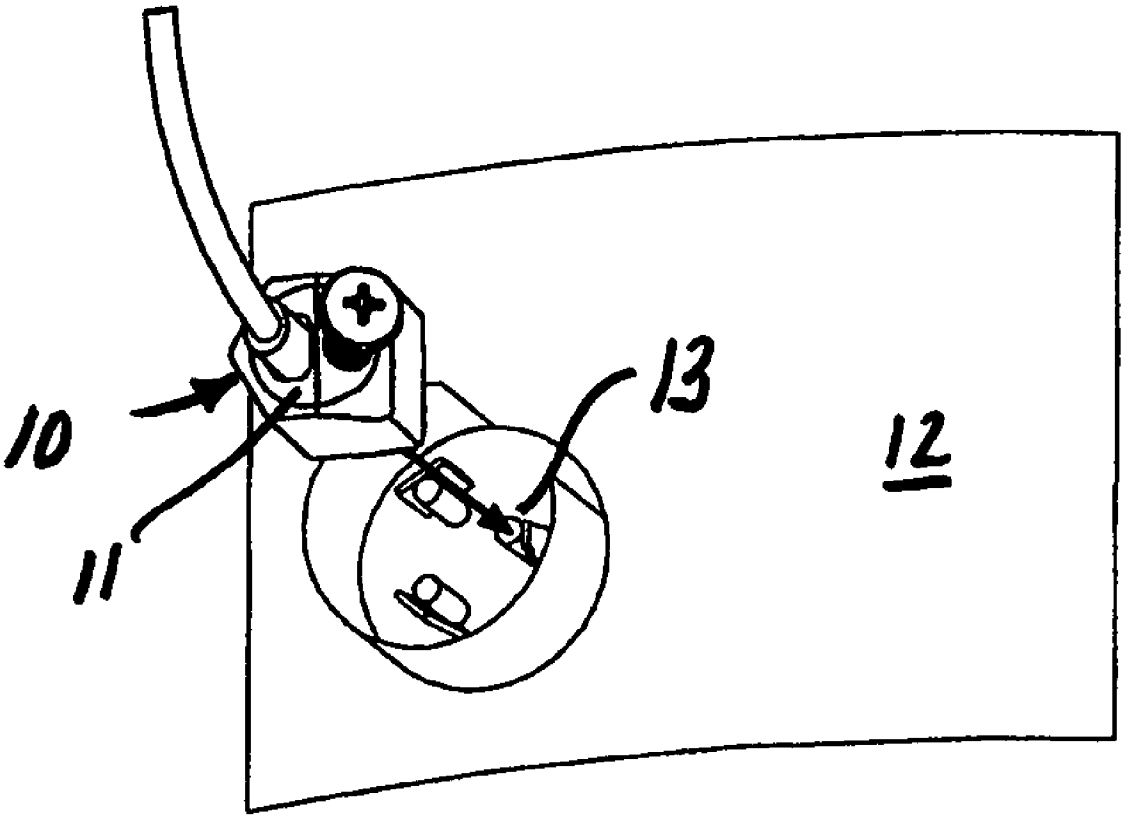
FIG. 2 is a similar perspective view of the retrofit arrangement but is shown in relation to the insertion direction to the terminals on the compressor.
Figure 3:
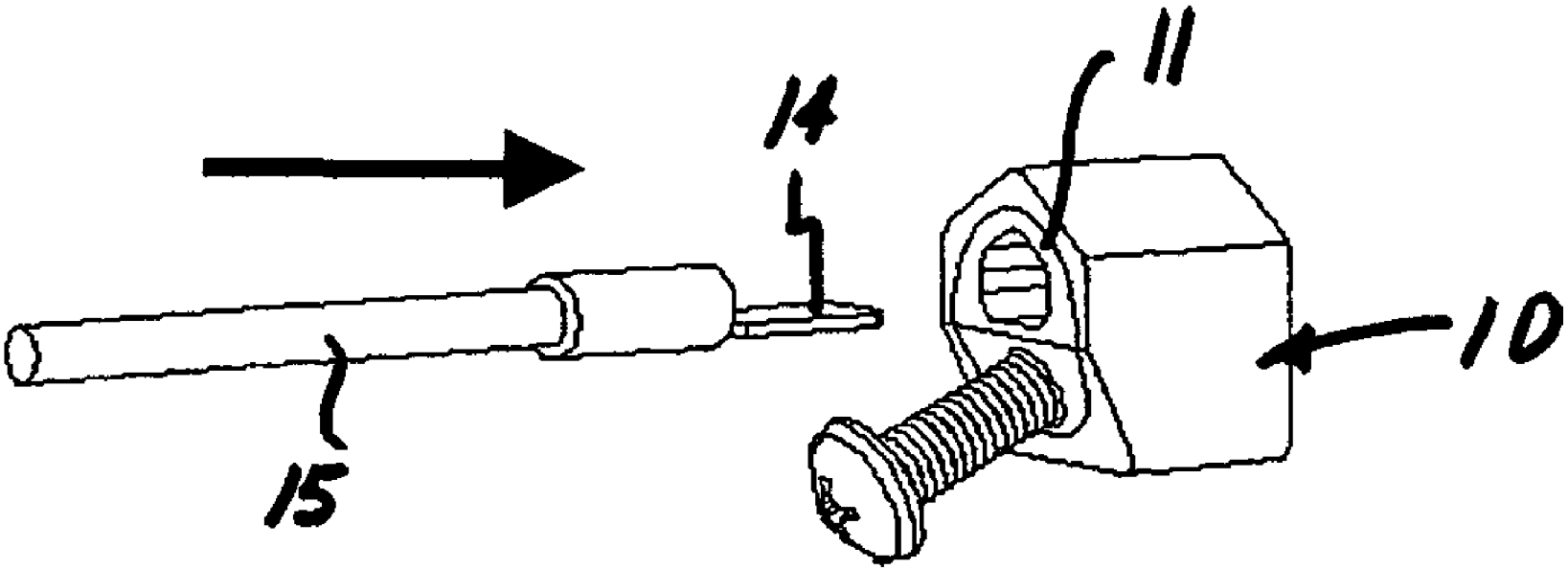
FIG. 3 is a view showing the correct manner of insertion of the lead and its associated spade in the connector body.
Figure 4:
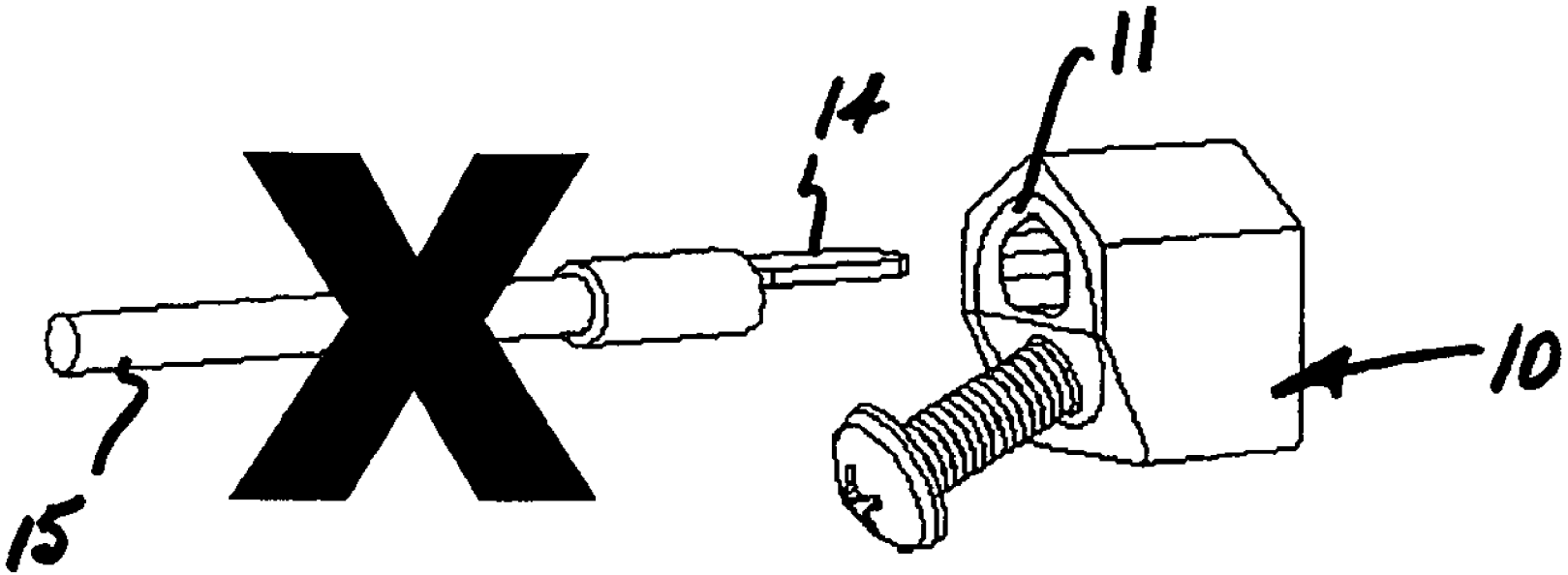
FIG. 4 is a view similar to FIG. 3 but showing the incorrect manner of insertion.

FIG. 2 shows the orientation of the retrofit arrangement 10 as it is assembled in the direction of the arrow onto the post 13 of the compressor 12. On one hand, FIG. 3 shows the correct (or more optimal) orientation of the metal spade 14 at the end of the electrical lead 15 as it is to be inserted into the connector body 10. On the other hand, FIG. 4 shows the less optimal way of inserting the lead 15 and its associated spade 14 in the connector body 10.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. In a retrofit arrangement for attaching an electrical lead to a terminal, which arrangement includes a body having a passage through top and bottom ends thereof for removably placing the body over and substantially surrounding the terminal and a wedging apparatus operatively arranged in the body for rotating about an axis oblique to an opening on the passage at the bottom end of the body and having an edge portion configured to directly contact one of the terminal and the lead at an angle of other than 90° for forming, with substantially only the edge portion, a wedge-shaped configuration and force-holding the terminal and lead directly together and against the body, with the axis of the wedging apparatus passing through an aperture in the body near or at one of the top and bottom ends, the improvement comprising the body consisting of a conductive central portion and a non-conductive portion substantially surrounding the central portion, wherein the conductive central portion is comprised of a material that is softer than the material which comprises the terminal.

2. In the retrofit arrangement according to claim 1, wherein the conductive central portion is comprised of a soft conducting material.

3. In the retrofit arrangement according to claim 1, wherein the conductive central portion is comprised of brass, copper, aluminum or stainless steel.

4. In the retrofit arrangement according to claim 1, wherein the wedging apparatus is conductive.

5. In the retrofit arrangement according to claim 1, wherein the lead includes a spade connector.

6. In the retrofit arrangement according to claim 1, the body is configured to have the lead enter therein at a top surface thereof.

7. In the retrofit arrangement according to claim 1, wherein the body has a multi-faced, flat-sided outer configuration and an aperture for receiving the terminal and the lead.

8. In the retrofit arrangement according to claim 1, wherein the body has a polygonal opening with two sides angled toward one another for receiving the terminal and the lead.

9. In the retrofit arrangement according to claim 1, wherein the body has an opening configured to receive the terminal and the lead from different ends of the body.

10. In the retrofit arrangement according to claim 1, wherein the opening is of pentagon configuration.

* * * * *